United States Patent [19]

Tamatani

[11] Patent Number: 4,688,606

[45] Date of Patent: Aug. 25, 1987

[54] IMPROPER WEFT REMOVING DEVICE FOR SHUTTLELESS LOOMS

[75] Inventor: Yasuyuki Tamatani, Kanazawa, Japan

[73] Assignee: Tsudakoma Corporation, Ishikawa, Japan

[21] Appl. No.: 856,063

[22] Filed: Apr. 23, 1986

[30] Foreign Application Priority Data

| | | | |
|---|---|---|---|
| Feb. 7, 1985 | [JP] | Japan | 60-16493[U] |
| Apr. 24, 1985 | [JP] | Japan | 60-89720 |
| Aug. 30, 1985 | [JP] | Japan | 60-133182[U] |
| Sep. 11, 1985 | [JP] | Japan | 60-138089[U] |

[51] Int. Cl.[4] ..... D03D 47/00

[52] U.S. Cl. ..... 139/116; 139/429; 139/435

[58] Field of Search ..... 139/1 R, 116, 429, 435

[56] References Cited

U.S. PATENT DOCUMENTS

| | | | |
|---|---|---|---|
| 4,502,512 | 3/1985 | Suzuki et al. | 139/116 |
| 4,503,889 | 3/1985 | Mullekom | 139/1 R |
| 4,529,010 | 7/1985 | Aarts | 139/116 |
| 4,559,976 | 12/1985 | Araki et al. | 139/435 |

FOREIGN PATENT DOCUMENTS

| | | |
|---|---|---|
| 56-17503 | 4/1981 | Japan . |
| 59-21757 | 2/1984 | Japan . |

*Primary Examiner*—Henry S. Jaudon

*Attorney, Agent, or Firm*—Flynn, Thiel, Boutell & Tanis

[57] ABSTRACT

An improperly inserted weft removing device for a shuttleless loom which weaves a fabric by picking a weft measured and stored on a measuring and storing device into a shed of warps by the agency of a jet of a fluid jetted through a picking nozzle, said weft removing device including a winding unit for extracting an improperly inserted weft from the cloth fell of the cloth being woven on the shuttleless loom upon the occurence of a mispick; a guide nozzle for deflecting the weft from the picking path and guiding the same to a predetermined position in the winding unit, which is disposed between the picking nozzle and the edge of the cloth on the picking side; a cutter for cutting the weft extending between the picking nozzle and the winding unit; and a controller for controlling the winding unit, the guide nozzle and the cutter for a series of sequential weft removing actions.

26 Claims, 15 Drawing Figures

IMPROPER WEFT REMOVING DEVICE FOR SHUTTLELESS LOOMS

BACKGROUND OF THE INVENTION

1. Field of the Invention

The present invention relates to an automatic mending device for automatically restarting a loom after removing an improperly picked weft from the cloth fell and, more particularly, to an improper weft removing device capable of extracting an improperly picked weft from the cloth fell by winding up the improperly picked weft.

2. Description of the Prior Art

An automatic mending device is disclosed in Japanese Utility Model Publication No. 56-17503. This automatic mending device removes an improperly inserted weft from the cloth fell, and then places the same weft properly in the shed by means of a picking nozzle and suction means disposed on the picking side and the arriving side of the loom, respectively. Such a mending manner of the prior art automatic mending device is undesirable in view of the quality of the cloth, because the weft once picked up improperly and beaten into the fabric with the reed is woven in the cloth.

An invention disclosed in Unexamined Japanese Patent Publication No. 59-21757 extracts an improperly inserted weft by the suction of a suction nozzle or by the winding action of a waste removing roller after separating the improper weft from the cloth fell. However, according to the prior invention, the improperly inserted weft needs to be separated from the cloth fell prior to extraction and hence requires special separating means for separating the improper weft from the cloth fell.

SUMMARY OF THE INVENTION

Accordingly, it is a first object of the present invention to enable easy extraction of an improperly inserted weft from the cloth fell without using any special separating means such as employed by the prior art and to enable the elimination of the extracted weft in a form facilitating subsequent disposal of the eliminated improper weft.

According to the present invention, upon the occurence of a mispick, namely, when a weft stop signal is given by a weft stop motion controller, the rear end portion of the improper weft extending in the vicinity of a picking nozzle is moved into a winding unit by the action of a guide nozzle disposed near the picking nozzle, then the improperly inserted weft is then cut at a position in a portion thereof extending between the winding unit and the picking nozzle with a cutter, and then the winding unit winds the improperly inserted weft in a manner pulling the same away from the cloth fell to extract the weft from the shed.

The winding unit holds the rear end portion of the improperly inserted weft between a tubular rotary member and a winding member and winds up the weft on the winding member. Upon the completion of winding-up the weft, the winding member is separated from the rotary member to release the weft gathered in loops in order to facilitate subsequent disposal of the extracted weft. The winding member serves also as an ejecting nozzle. After being separated from the rotary member, the winding member blows air through a hole therein in order to eject the loops of the weft. The winding member is embodied in a rotary piston capable of axially sliding within a housing relative to the rotary member. Accordingly, the axial movement of the winding member relative to the rotary member is controlled by a dynamic fluid.

It is a particular feature of the present invention to position the winding unit away from normal picking path traveled by weft threads so that the improperly inserted weft is pulled in a direction away from the cloth fell as it is wound up by the winding unit. Accordingly, the improperly inserted weft is pulled gradually away from the cloth fell and hence the weft can be extracted easily by a comparatively small force. The pulling dirction is decided by the disposition of the winding unit or an auxiliary yarn guide. Naturally, the winding member and the rotary member are rotated with a sufficient torque to extract the improperly inserted weft, and the pulling speed of the winding member and the rotary member is optionally controlled in accordance with the strength of the weft to be extracted.

SUMMARY OF THE INVENTION

An arrangement according to the present invention for solving the problem of the conventional improperly inserted weft removing device has the following characteristics.

First, an improperly inserted weft is extracted by the positive winding motion of a winding unit and the weft is pulled away from the cloth fell and toward the shed as it is wound up. Accordingly, a special operation for separating the improperly inserted weft from the cloth fell is not necessary in removing the weft, and hence the weft removing device does not have any sophisticated mechanism for separating the improperly inserted weft from the cloth fell and the weft removing device is simplified accordingly.

Furthermore, according to the present invention, since an improperly inserted weft is wound up positively by a driving rotary member and a rotatable and axially movable winding member in a form facilitating the ejection of the extracted weft, the weft can be surely and smoothly wound up and ejected. Still further, since the improperly inserted weft is held between the rotary member and the winding member prior to the start of a winding operation, the weft is wound positively and is extracted by a sufficient force.

Incidentally, when the improperly inserted weft is not guided properly to the winding unit or when the improperly inserted weft is broken while being guided to the winding unit or while being extracted from the cloth fell, complete extraction of the improper weft is impossible.

Accordingly, it is a second object of the present invention to detect the condition of extraction of the improperly inserted weft electrically during the weft removing operation and to control the subsequent operation of the loom properly according to the results of the detection.

In order to achieve such an object, according to the present invention, the presence of an improperly inserted weft is detected at a predetermined position near the winding device at the start and after the completion of a weft winding-up operation, and the start or interruption of the improper weft removing operation or the restart of the loom is controlled according to the results of the detection. Particularly, the present invention detects the condition of the weft removing operation and the progress of the weft removing operation through the comparison of a time necessary for the extraction of the improper weft with a reference time.

Under the above-mentioned control mode, the presence of the weft is detected by a detector on the side of the winding unit during and after the completion of the weft extracting operation and appropriate measures are taken according to the existing condition of the weft extracting operation. Therefore, erroneous operation in that the loom is restarted when the weft is not fully extracted is prevented without failure. Accordingly, complete automatic mending function is ensured.

DESCRIPTION OF THE PREFERRED EMBODIMENT

Figure 1:
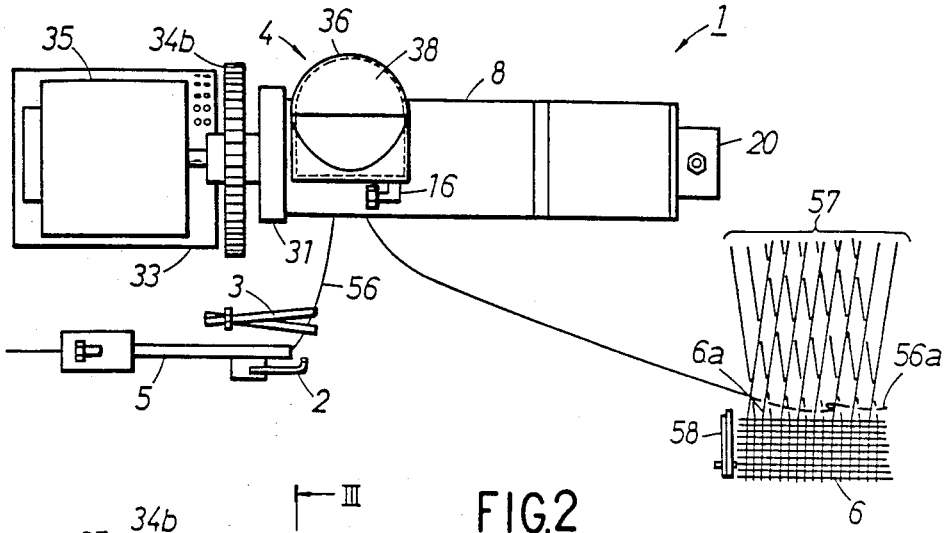
FIG. 1 is a plan view of a weft removing device according to the present invention.
Figure 2:
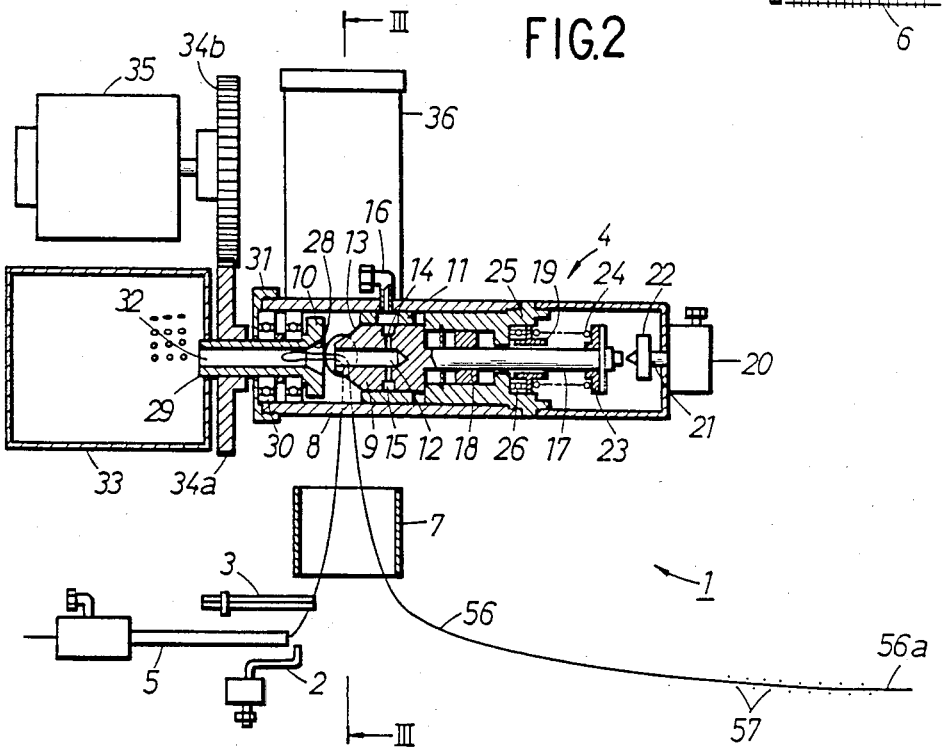
FIG. 2 is a longitudinal sectional side elevation of the improper weft removing device of FIG. 1.
Figure 3:
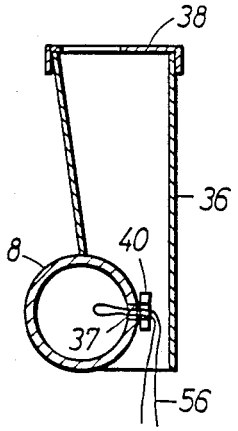
FIG. 3 is a sectional view taken on line III–IV in FIG. 2.

FIGS. 1 to 3 illustrate the mechanical constitution of an improperly inserted weft removing device, 1, which comprises, as the principal units thereof, a guide nozzle 2, a cutter 3 and a winding unit 4.

The guide nozzle 2 is disposed between a picking nozzle 5 and the picking side of a fabric or cloth 6 and is directed in a direction deviating from the picking path, for example, obliquely upward. The cutter 3 is disposed adjacent to the head of the picking nozzle 5 and near a tubular yarn guide 7. In this embodiment, the cutter 3 and the yarn guide 7 are held fixedly by suitable supporting means.

The winding unit has a winding member 9 and a rotary member 10 which are supported rotatably within a tubular housing 8. The winding member 9 is supported for rotation and axial sliding movement with a rod 17 supported by a stroke bearing 18. A nozzle 12 is formed in the central portion of the free end of the winding member 9. A conical winding surface 13 is formed on the circumference of the free end of the winding member 9. The nozzle 12 communicates with a connector 16 attached to the housing 8 for introducing a fluid therethrough, by means of radial holes 14, an annular groove 15 formed in the circumference thereof and a hole formed through a sliding bearing 11. The winding member 9 and the rod 17 are formed coaxially and integrally in a single member. The rod 17 is supported axially slidably by the stroke bearing 18. The free end of the rod 17 is located opposite to a pressing member 22 fixed to the piston rod 21 of a power cylinder 20. The rod 17 is urged always rightward, as viewed in FIG. 2, by a coil spring 24 provided between a sleeve 19 serving also as a spring seat and a spring seat 23. The rightward movement of the winding member 9 is limited by a cap 25, while the leftward movement of the same is limited by the rotary member 10. The sleeve 19 is supported rotatably on a ball bearing 26 within the cap 25 attached to the free end of the housing 8.

A conical recess 28 having a conical surface complementary to the conical winding surface 13 is formed in the rotary member 10 opposite to the winding surface 13. The hollow rotary shaft 29 of the rotary member 10 is supported rotatably on ball bearings 30 within the housing 8. The ball bearings 30 are held in place by an end cap 31 attached to the open end of the housing 8. An ejecting passage 32 opening into a trash box 33 is formed through the rotary shaft 29. A gear **34*b* fixed to the output shaft of a driving motor 35 is meshed with a gear 34*a* attached to the rotary member 10 to drive the rotary member 10** rotatably at a predetermined speed.

Figure 4:
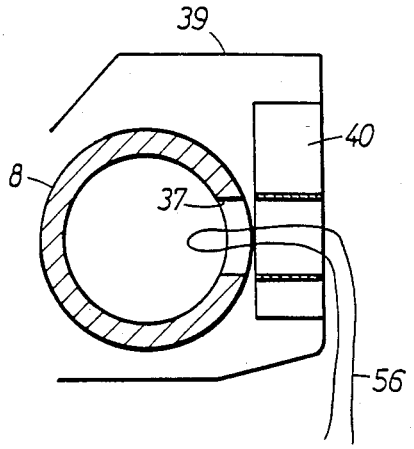
FIG. 4 is an enlarged fragmentary sectional view showing a detector and and associated components from the device of FIG. 3.
Figure 5:
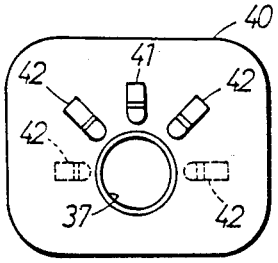
FIG. 5 is an enlarged front elevation of the detector of FIG. 4.

The winding member 9 and the rotary member 10 are disposed opposite to each other with a suitable space therebetween within the housing 8. A guide tube 36 extends transversely to and is joined to the housing 8 at a position corresponding to the space between the winding member 9 and the rotary member 10. The upper and lower ends of the guide 36 are open. The interior of the guide tube 36 communicates with the space between the winding member 9 and the rotary member 10 by means of a guide hole 37 formed in the housing 8 at a position corresponding to a position below the middle of the guide tube 36. If necessary, a cover plate 38 may be attached to the upper open end of the guide tube 36. As illustrated in FIGS. 4 and 5, a detector 40 is disposed near the guide hole 37 and is held on a detector holding plate 39. The detector 40 comprises a light emitting element 41 and two light receiving elements 42. The light emitting element 41 and the light receiving elements 42 are directed toward the center of the guide hole 37 and the light receiving elements 42 are disposed symmetrically with respect to a center line passing the center of the guide hole 37 and the light emitting element 41.

Figure 6:
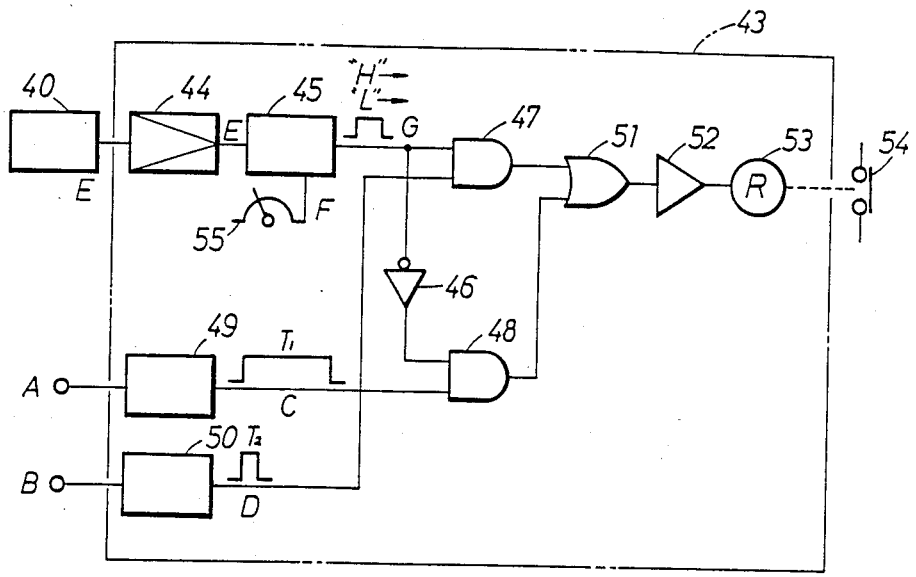
FIG. 6 is a block diagram of a control unit of the device of FIG. 1.

Referring now to FIG. 6 showing the constitution of a control unit 43, the detector 40 is connected through an amplifying circuit 44 to one of the input terminals of a comparator 45. A reference setting device 55 is connected to the other input terminal of the comparator 45. The output terminal of the comparator 45 is connected directly to one of the input terminals of an AND gate 47 and through a NOT circuit 46 to one of the input terminals of an AND gate 48. A first timer 49 and a second timer 50 provide timer signals C and D of fixed times T1 and T2 upon the reception of a winding start signal A and a winding end signal B, respectively. The first and second timers 49 and 50 are connected to the other input terminals of the AND gates 48 and 47, respectively. The output terminals of the AND gates 47 and 48 are connected to the input terminals of an OR gate 51. The OR gate 51 is connected through a driver 52 to a relay 53. A contactor 54 of the relay 53 is incorporated into a circuit which generates a signal to inhibit the restart of the loom or a signal to interrupt the weft removing operation.

Figure 7:
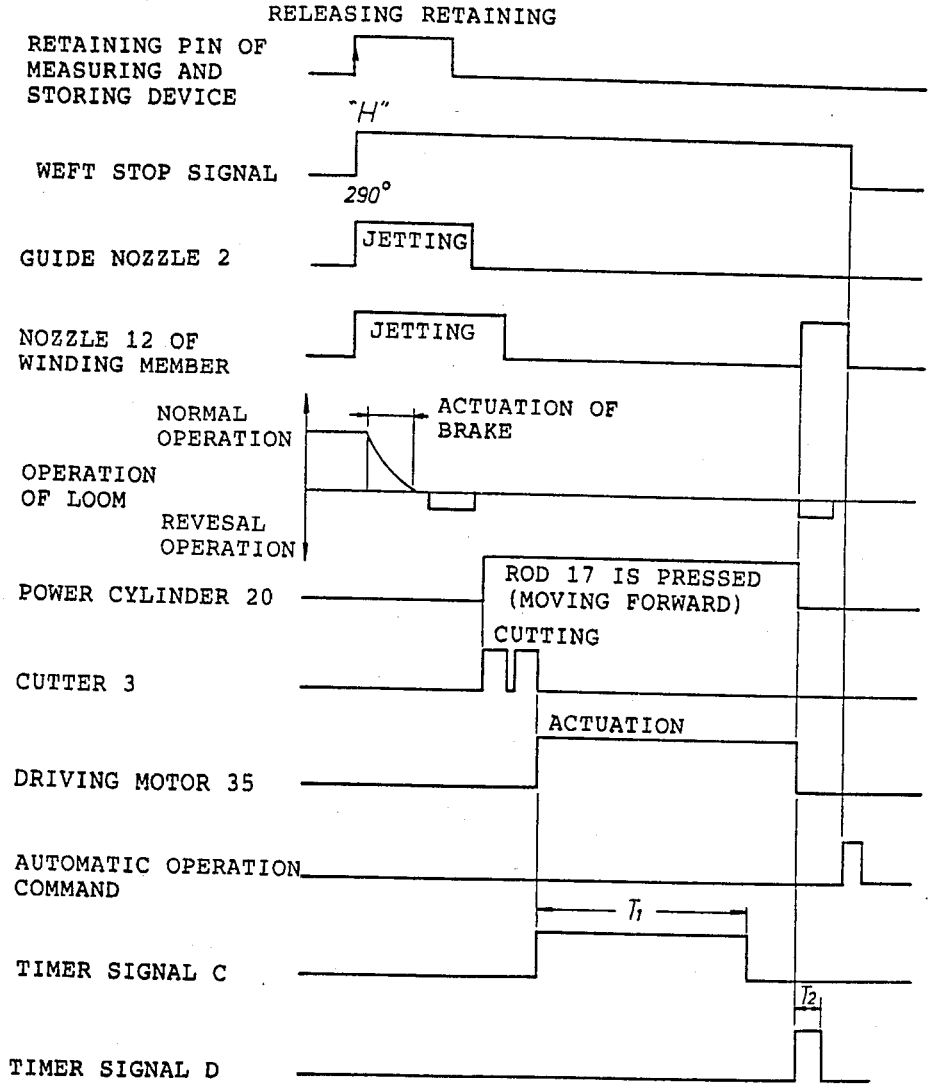
FIG. 7 is a time chart showing the sequential operation of the components of the weft removing device of FIG. 1.

FIG. 7 shows a series of sequential actions of the weft removing device 1.

In the normal picking operation, the picking nozzle 5 pulls out wefts 56 from a measuring and storing device and picks the wefts 56 successively into sheds of warps 57.

Upon the occurrence of a mispick, a weft stop motion unit provides an H-level (Logic "1") signal, namely, a weft stop signal, to actuate a brake so that the loom is stopped automatically in the next weaving cycle. A mispick is detected by a well-known yarn sensor or the like positioned at the edge of the cloth on the arriving side where the picked weft 56 arrives.

Upon the reception of the weft stop signal, the measuring and storing device, not shown, releases the weft 56 so that the weft 56 of an appropriate length can be supplied to the picking nozzle 5. This appropriate length is such a length necessary for extending the weft 56 at least from the picking nozzle 5 to the guide hole 37 of the winding device 4. The free weft 56 of such an appropriate length can be obtained, when the measuring and storing device is of a drum type, by retracting the retaining pin to unwind, for example, one turn of the weft 56 on the drum or, when the measuring and storing device is of a roller-pneumatic type, by temporarily unclamping the weft 56 for a predetermined time.

When the weft stop signal is given to the loom the guide nozzle 2 blows air to blow the weft 56 extending between the picking nozzle 5 and the cloth 6 into the tubular yarn guide 7 of the winding device 4 to avoid the weft 56 extending from the edge of the cloth 6 being cut by the cutter 58.

At the same time, compressed air supplied from an external compressed air source is blown through the nozzle 12 of the winding member 9 into the ejecting passage 32 of the rotary member 10 to produce a negative pressure in the space between the winding member 9 and the rotary member 10 and its vicinity. Consequently, the weft 56 is sucked through the guide tube 36 and the guide hole 37 into the ejecting passage 32. While the weft 56 is being sucked into the guide tube 36, the cutter 3 performs a cutting operation. However, since the weft 56 is moved away from the cutter 58, the cutter 58 is unable to cut the weft 56 and hence the weft 56 and the improperly inserted weft 56*a* still remain continuous. While the weft 56 is thus being controlled for the improper weft extracting operation, the loom is stopped in the next picking cycle succeeding the improper picking cycle, and then the loom is reversed to open the warp shed as it was when the improperly inserted weft 56*a* was inserted. At this moment, the guide nozzle 2 stops blowing air while the winding member 9 continues blowing compressed air through the nozzle 12 for some time after the loom has been reversed.

While compressed air is still being blown through the nozzle 12, the power cylinder 20 is actuated to cause piston rod 21 to shift the rod 17 leftward, as viewed in FIGS. 1 and 2, against the resilient force of the coil spring 24. Consequently, the conical winding surface 13 of the winding member 9 is pressed against the conical recess 28 of the rotary member 10 to hold the weft 56 between the conical winding surface 13 and the conical recess 28. At the same time, the cutter 3 is actuated to cut the weft 56 extending between the picking nozzle 5 and the yarn guide 7 at a position near the picking nozzle 5.

Then, the driving motor 35 is actuated automatically to rotate the rotary member 10. Since the winding surface 13 and the surface of the conical recess 28 are joined frictionally, the winding member 9 is driven by the rotary member 10 at the same speed as the rotary member 10 to wind the weft on the winding surface 13, so that the improper weft 56*a* is extracted from the cloth fell 6*a*. Since the yarn guide 7 is offset toward the shed of the warps 57 from an extension of the cloth fell 6*a*, and hence the improper weft 56*a* is pulled in a direction obliquely deviating toward the shed of the warps 57 from the cloth fell 6*a*, the improper weft 56*a* is extracted under a small resistance and practically without interfering with the warps 57. The improper weft 56*a* can be pulled in such a direction by disposing the yarn guide 7 or the winding unit 4, more specifically the guide tube 36 of the winding unit 4 when the yarn guide 7 is not provided, at a position offset toward the shed from the cloth fell 6*a*.

Thus the winding member 9 and the rotary member 10 wind the improper weft 56*a* in loops on the winding surface 13. After the winding operation has continued for a fixed period of time, the driving motor 35 is stopped automatically. Prior to stopping the driving motor 35, the piston rod 21 of the power cylinder 20 is retracted to allow the coil spring 24 to separate the winding surface 13 from the conical recess 28. Simultaneously, compressed air is blown through the nozzle 12 to blow the loops of the improper weft 56*a* toward the conical recess 28. Consequently, the loops of the improper weft 56*a* are ejected through the ejecting passage 32 of the hollow rotary shaft 29 into the trash box 33. After the improper weft 56*a* has thus been removed, the loom is reversed further by a necessary phase angle, and then starts the normal weaving operation upon the reception of an automatic operation command.

During a series of the improper weft removing actions, the detector detects the entrance of the improper weft 56*a* into the guide hole 37 photoelectrically and provides a detection signal E. The detection signal E is applied to the input terminal of the comparator 45 after being amplified by the amplifying circuit 44. The comparator 45 compares the detection signal E with a predetermined reference value F and, when the result of the comparison indicates that the improperly inserted weft 56*a* is in the guide hole 37, provides a comparison signal G of H-level, which is given to the AND gate 48 after being inverted by the NOT ciurcuit.

On the other hand, upon the reception of a winding start signal A of H-level at an appropriate time, the first timer 49 provides a timer signal C of H-level for a predetermined time T1. The timer signal C is applied to the other imput terminal of the AND gate 48. While the timer signal C is on H-level, the AND gate 48 provides an output signal of H-level when the comparator 45 provides an output signal indicating that any improperly inserted weft is not in the guide hole 37, namely, a comparison signal G of L-level. The output signal of H-level of the AND gate 48 is given through the OR gate 51 to the driver 52 to actuate the driver 52. Consequently, the contactor 54 of the relay 53 is closed, and thereby the control unit of the loom provides a command to inhibit the restart of the loom or to interrupt the weft removing operation so that the winding operation is interrupted. Such a control operation is executed when the yarn guide malfunctions or the improperly inserted weft is broken accidentally during the weft removing operation.

Upon the completion of the weft winding operation, a winding end signal B is given to the second timer 50. Then, the second timer 50 provides a timer signal D of H-level for a predetermined time T2. If the comparator 45 provides the comparison signal G of H-level indicating the existence of the yarn while the timer signal D is on H-level, the contactor 54 of the relay 53 is closed, through the same process as mentioned above, to provide the restart inhibition command or the improper weft removing operation interruption command. Such a control operation is executed when the winding operation is performed improperly or the yarn is broken.

The winding start signal A and the winding end signal B are provided, for example, at a moment when the driving motor 35 is started and at a moment when the same is stopped, respectively.

In this embodiment, the detector 40 is disposed at an optimum position near the guide hole 37 within the guide tube 36, however, the detector 40 may be disposed at another position, for example, at a position near the yarn guide 7. In this embodiment, the detector 40 comprises one light emitting element 41 and two light receiving elements 42, however, the detector 40 may comprise a plurality of light emitting elements 41 and a plurality of light receiving elements 42.

Figure 8:
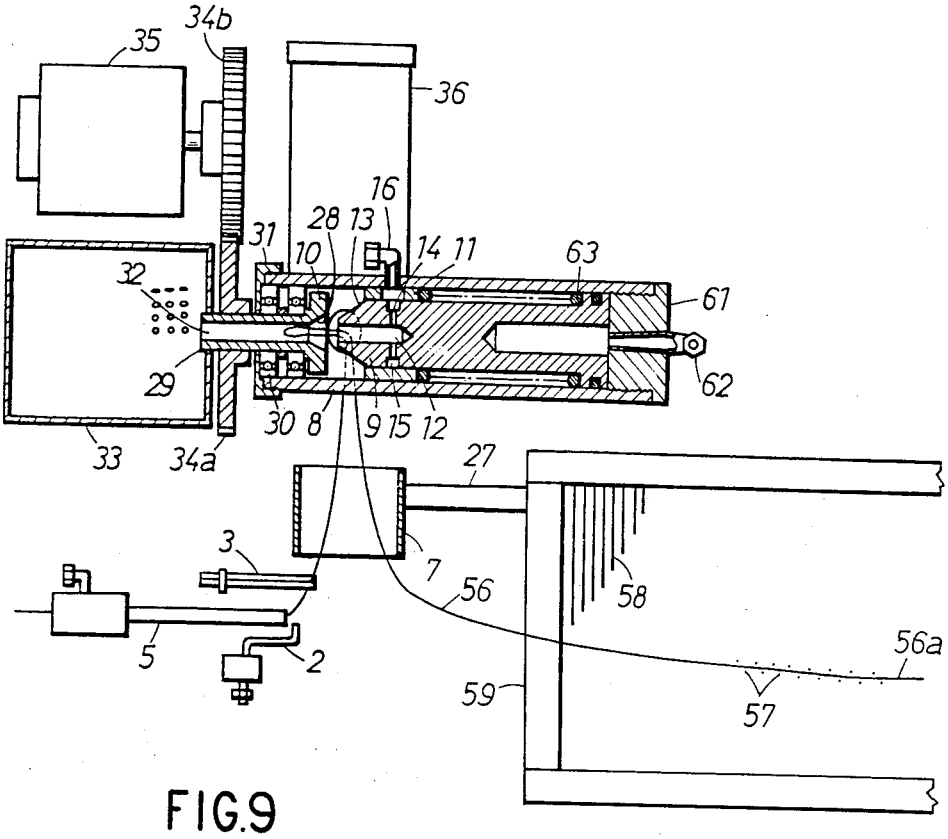
FIG. 8 is a front elevation of an alternative arrangement showing a different arrangement of a yarn guide.
Figure 9:
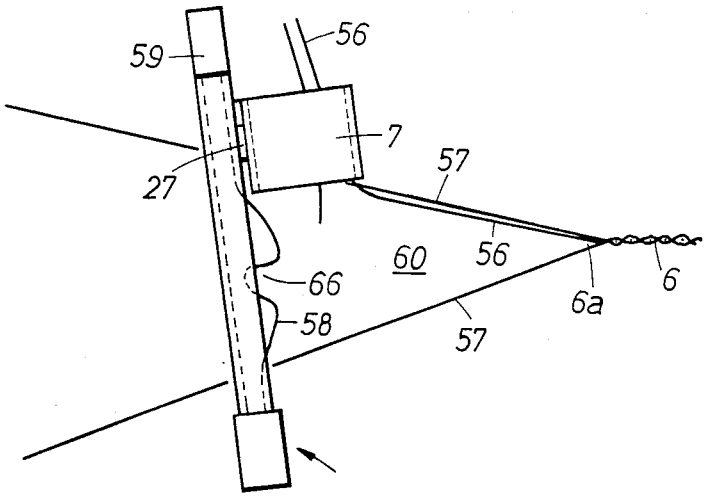
FIG. 9 is a side elevation showing the yarn guide of FIG. 8, FIGS. 10 and 11 are side elevations showing respective modifications of the yarn guide of FIG. 8.

FIGS. 8 and 9 show a second embodiment of the present invention, in which a yarn guide 7 similar to that of the first embodiment is shifted in extracting an improperly inserted weft 56*a*. The yarn guide 7 is held on the reed frame 59 of a reed 58 so that the lower opening thereof faces the triangular region (see FIG. 9) formed by the reeds 58 and the shed 60 of the warps 57. Upon the occurence of a mispick, the reed frame 59 is stopped at a position where the yarn guide 7 is located between a guide nozzle 2 and a guide tube 36. Accordingly, a weft 56 is guided through the yarn guide 7 to the guide tube 36.

Since the reed frame 59 is moved for one cycle of bearing motion by reversing the loom after a mispick has occurred, the yarn guide 7 pulls the weft from the cloth fell 6*a* toward the shed 60 of the warps 57 as the reed 58 is moved away from the cloth fell 6*a*. Thus, the improperly inserted weft 56*a*, particularly, a portion of the weft 56*a* on the picking side of the cloth, is separated from the cloth fell 6*a*. Since the yarn guide 7 is located so that the weft 56*a* is pulled, in a direction obliquely deviating toward the shed 60 of the warps 57, from the extension of the cloth fell 6*a* without interfering with the warps 57, the weft 56 which was partly separated from the cloth fell 6*a* during the reverse operation of the loom is extracted by being pulled away from the cloth fell 6*a* toward the shed 60 by a small force.

In the second embodiment shown in FIG. 8, a housing 8 serves also as a cylinder while a winding member 9 serves also as a piston. A working fluid is supplied through an inlet formed in an end cap 61 into the housing 8 to bring the winding member 9 into contact with a rotary member 10 against the resistance of a coil spring 63.

In the second embodiment, the tubular yarn guide 7 is held on the reed frame 59, however, the yarn guide 7 may be held on another member which is reciprocated similarly to the reed frame 59.

Figure 10:
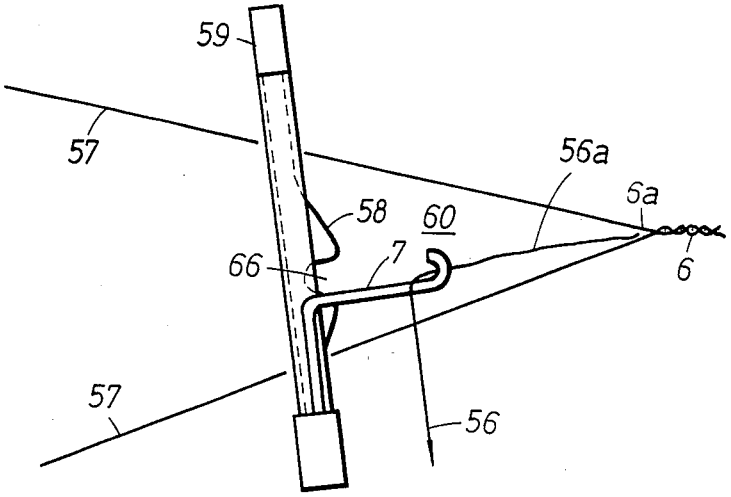
Figure 11:
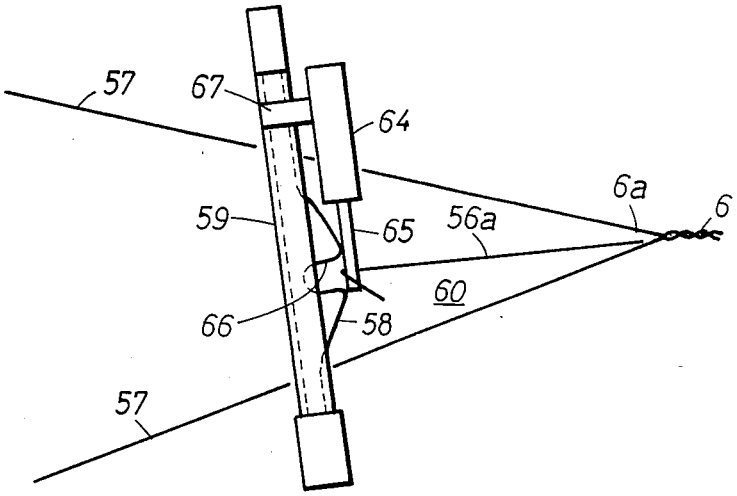

Furthermore, the yarn guide 7 need not necessarily be formed in a tubular shape so long as the yarn guide is able to guide the weft 56 properly. Therefore, the yarn guide 7 may be formed in the shape of a hook and may be fixed to the reed frame 59 as illustrated in FIG. 10, or the yarn guide 7 may be replaced with an electromagnetic yarn guide 64 having a movable rod 65 which as shown in FIG. 11, guides the weft 56 extending between the movable rod 65 and the air guide 66 of the reed 58.

In the second embodiment, since the improperly inserted weft 56*a* is separated positively from the cloth fell 6*a*, the weft 56*a* can be extracted by a small force under a small resistance of the warps 57. Furthermore, since the direction of extraction of the weft 56*a* is dependent on the position of the yarn guide 7, the winding unit 4 may be disposed at an optional position.

Figure 12:
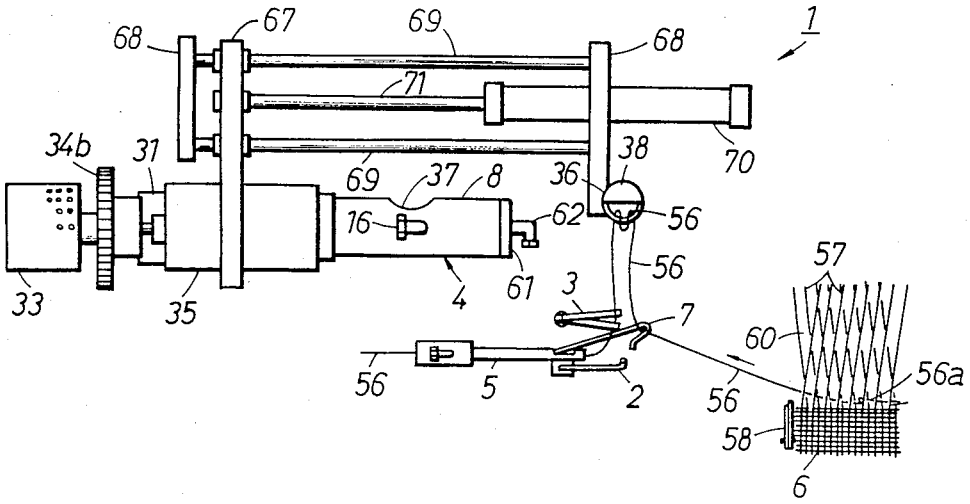
FIG. 12 is a plan view of an alternative embodiment having a movable weft removing device provided on a loom.
Figure 13:
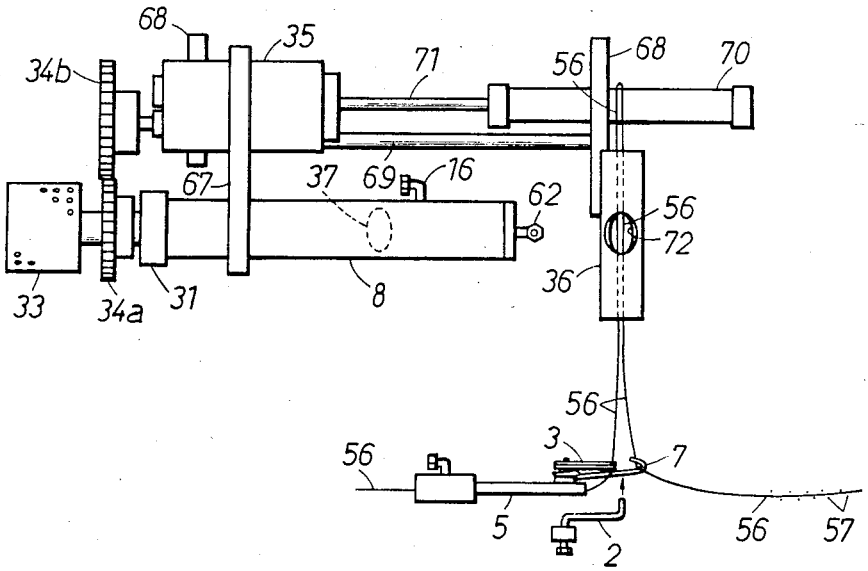
FIG. 13 is a front elevation of the movable weft removing device of FIG. 12.

FIGS. 12 and 13 show a third embodiment of the present invention in which a housing is movable while a guide tube 36 is stationary.

In the third embodiment, a winding unit 4 is supported by a bracket 67 on two horizontal guide rods 69 extending between a pair of frames 68 so as to be movable along the guide rods 69 in a direction parallel to the cloth fell 6*a*. The bracket 67 is connected to the piston rod 71 of a power cylinder 70 mounted on one of the frames 68. Thus, the bracket 67, the frames 68, the guide rods 69 and the power cylinder 70 constitute a winding unit shifting means. A guide tube 36 is held fixedly on the frame 68 near the edge of the cloth so as to be disposed opposite to the guide hole 37. The guide tube 36 extends perpendicular with respect to the housing 8 and has upper and lower open ends. A guide hole 72 is formed in the guide tube 36 at the middle thereof so as to be opposite to the guide hole 37 of the housing 8 when the winding unit 4 is moved to the operating position. When the winding unit 4 is moved to the operating position, a weft guided by the guide tube 36 is able to enter the space between a rotary member 10 and a winding member 9 through the guide holes 72 and 37. In this embodiment, the yarn guide 7 is a hook fixed to the free end of a picking nozzle 5 together with a guide nozzle 2.

Prior to guiding a weft 56 to the winding unit 4, the piston rod 71 of the power cylinder 70 is projected to move the winding unit 4 from the resting position to the operating position, where the guide hole 37 formed in the housing 8 is located opposite to the guide hole 72 of the guide tube 36 so that a weft is able to be sucked from the guide tube 36 into the housing 8 through the guide holes 72 and 37. Then, air is blown through a nozzle 12 formed in the winding member 9 to produce an air current from the guide tube 36 through the guide holes 72 and 37 into an ejecting passage formed in the rotary member 10. Consequently, the weft 56 guided into the guide tube 36 is caused to enter the ejecting passage 32 through the guide holes 72 and 37, together with the air current.

Figure 14:
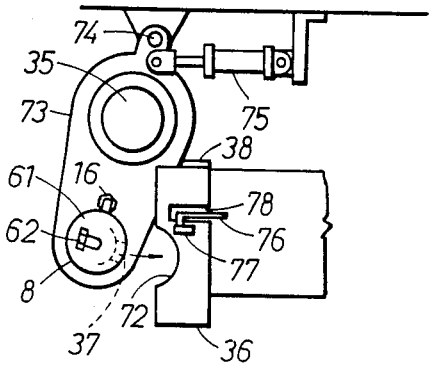
FIG. 14 is a side elevation showing another configuration of a movable weft removing device.
Figure 15:
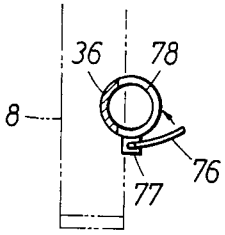
FIG. 15 is a cross section of a guide sleeve in the embodiment of FIG. 14.

In the third embodiment, the winding unit 4 is linearly movable, while in a fourth embodiment shown in FIGS. 14 and 15, a winding unit 4 is supported by a bracket 73 on a supporting shaft 74 so as to be turnable. The bracket 73 is turned on the supporting shaft 74 by a power cylinder 75. In the fourth embodiment, a guide hole 37 formed in a housing 8 is always located opposite to a guide hole 72 formed in a guide tube 36 and hence a weft 56 can be surely sucked into the housing 8. The fourth embodiment is provided with a transfer bar 76 for positively transferring the weft 56 from the interior of a guide tube 36 to a guide hole 37 formed in the housing 8 of the winding unit 4. The transfer bar 76 is attached together with a rotary actuator 77 to the side wall of the guide tube 36. The transfer bar 76 is moved through a slit 78 formed in the guide tube 36 into the guide tube 36 to transfer the weft 56 from the interior of the guide tube 36 to the guide hole 37.

In the third and fourth embodiment, the winding unit 4 is moved near to the guide tube 36. However, it is also possible to move the guide 36 near to the winding unit 4 or to move both the winding unit 4 and the guide tube 36 toward each other.

In the third and fourth embodiments, the weft 56 is blown into the guide tube 36 with the guide nozzle 2, then the guide hole 72 of the guide tube 36 and the guide hole 37 of the winding unit 4 are positioned opposite to each other, and then the weft 56 is sucked positively from the guide tube 36 into the interior of the winding unit 4 by the agency of an air current. Therefore, reliable operation for winding the weft 56 and the improper weft 56*a* is achieved. Furthermore, the provision of the transfer bar 76 on the guide tube 36 further ensures the transfer of the weft 56 from the guide tube 36 to the interior of the guide hole 37 even when the air current for sucking the weft 56 into the guide hole 37 is unstable.

What is claimed is:

1. A weft removing device for a shuttleless loom which weaves a fabric by inserting a weft measured and stored on a measuring and storing device into a shed of warps by the agency of a fluid jetted through a picking nozzle, comprising: winding means for extracting an improperly picked weft from the fell of the fabric being woven in response to the occurrence of a mispick; guide nozzle means for deflecting the weft from a picking path and guiding it to a predetermined location in said winding means, said guide nozzle means being disposed between said picking nozzle and an edge of the fabric nearest said picking nozzle; cutter means for cutting the weft at a location between the picking nozzle and the winding unit; and controller means for selectively actuating said winding means, said guide nozzle means and said cutter means in a predetermined sequence; wherein said winding means includes:

a housing;

a rotary member rotatably supported within said housing and having an ejecting passage which is formed through a central portion thereof, which extends along an axis of rotation thereof, and through which an extracted weft can be ejected;

rotative driving means for driving said rotary member for rotation;

a winding member supported within said housing coaxially with said rotary member and so as to be rotatable, supported for axial movement relative to said rotary member between positions in contact with and separated from said rotary member, and provided with nozzle means formed in a central portion thereof for blowing compressed air into said ejecting passage of said rotary member;

axial driving means responsive to said controller means for axially shifting said winding member relative to said rotary member so as to bring said winding member into said position in contact with said rotary member and so as to move said winding member to said position separated from said rotary member; and detecting means for detecting the existence of a weft in a weft removing passage within said housing, said detecting means being operatively coupled to said controller means.

2. A weft removing device according to claim 1, wherein said axial driving means includes a coil spring yieldably urging relative axial movement of said winding member away from said rotary member, includes said housing having therein a power cylinder, and includes said winding member having a portion which serves as a piston and is slidably supported in said power cylinder, and including means for selectively supplying a fluid into said power cylinder in said housing so as to shift said piston axially to said position in which said winding member is in contact with said rotary member.

3. A weft removing device according to claim 1, wherein said winding means includes guide tube means for guiding an improperly picked weft into the interior of said housing of said winding means, and yarn guide means disposed between said guide tube means and said guide nozzle means for guiding the improperly picked weft and a portion of the weft continuous with the improperly picked weft to said guide tube means.

4. A weft removing device according to claim 3, wherein said guide tube means merges partly into said housing of said winding means.

5. A weft removing device according to claim 3, wherein said guide tube means is separate from said winding means, and said winding means and said guide tube means are supported for relative movement to a predetermined position appropriate for said winding means to receive an improperly picked weft from the interior of said guide tube means.

6. A weft removing device according to claim 3, wherein said winding means is stationary and said guide tube means is moved toward said winding means during movement to said predetermined position.

7. A weft removing device according to claim 3, wherein said winding means and said guide tube means are each movably supported and are moved toward each other during movement to said predetermined position.

8. A weft removing device according to claim 3, wherein said yarn guide means is secured to a reed frame of the shuttleless loom.

9. A weft removing device according to claim 1, wherein said controller means includes:

a comparator which compares a detection signal given by said detecting means with a reference value;

a first timer which provides a timer output signal for a predetermined period of time immediately after the start of a weft winding operation by said winding means;

a first AND gate which provides an output signal when said output signal of said first timer occurs simultaneously with an output signal from said comparator;

a second timer which provides a timer output signal for a predetermined period of time immediately following completion of a weft winding operation by said winding means;

a second AND gate which provides an output signal when said output signal of said second timer occurs simultaneously with said output signal from said comparator;

an OR gate which provides an output signal in response to the occurrence of said output signal from either of said first and second AND gates;

a driver responsive to said output signal of said OR gate; and a relay which is driven by said driver to give a signal indicating the occurrence of a weft removing operation to an external control circuit which controls the operation of the shuttleless loom.

10. An apparatus for removing an improperly inserted weft thread from a warp shed of a fabric being woven by a loom which inserts weft threads into the warp shed using jets of fluid emitted by a picking nozzle, comprising:

detection means for detecting a weft thread which has been improperly inserted into the warp shed;

a winding device having first and second members which each have a winding surface thereon, and having means supporting said first and second members for rotation about a common axis and for relative axial movement between a spaced position and an engaging position in which said winding surfaces are respectively spaced from and engaging each other, said first member having a passage which extends axially thereinto coaxial with said common axis and in a direction away from said second member, and said second member having a nozzle hole therein which opens toward and is aligned with said passage in said first member, said winding device further including rotational drive means for effecting rotation of one of said first and second members, axial drive means for effecting relative axial movement of said first and second members, and fluid jet means for causing a jet of fluid to be ejected from said nozzle hole in said second member in an axial direction toward said passage through said first member;

guide means for moving a portion of an improperly inserted weft thread to a location between said first and second members when said first and second members are in said spaced position; and control means operatively coupled to said winding device and said guide means and responsive to detection of an improperly inserted weft thread by said detection means for causing said guide means to move a portion of the improperly inserted weft thread to said location between said first and second members, for thereafter causing said axial drive means to effect movement of said first and second members to their engaging position so that the portion of the weft thread is clamped therebetween, for causing said rotational drive means to effect rotation of said one of said first and second members so that the weft thread is wound up onto said first and second members, and for thereafter causing said axial drive means to effect movement of said first and second members away from their engaging position and said fluid jet means to eject a jet of fluid through said nozzle hole in said second member so that the weft thread wound up by said first and second members is blown into said passage in said first member.

11. An apparatus according to claim 10, including cutter means for cutting an improperly inserted weft at a location in the region of said picking nozzle.

12. An apparatus according to claim 10, wherein said winding surfaces on said first and second members are frustoconical and diverge in diameter in an axial direction extending from said first member toward said second member.

13. An apparatus according to claim 10, including a box fixedly supported on said first member, and wherein said passage in said first member extends completely through said first member and opens into said box at an end of said passage remote from said second member.

14. An apparatus according to claim 10, wherein said guide means includes a yarn guide which guides the improperly inserted weft thread into said winding device as rotation of said first and second members wind the weft thread thereupon.

15. An apparatus according to claim 14, wherein said yarn guide is tubular.

16. An apparatus according to claim 14, wherein said yarn guide is a hook.

17. An apparatus according to claim 14, wherein said yarn guide is a piston rod of a fluid actuated cylinder.

18. An apparatus according to claim 14, wherein said yarn guide is stationarily supported at a location between said guide nozzle and said winding device.

19. An apparatus according to claim 14, wherein said yarn guide is supported on a movable reed frame of the loom.

20. An apparatus according to claim 10, wherein said winding device includes a cylindrical tubular housing extending concentrically to said common axis, having said first and second members therein and having an opening therein which is axially aligned with said location between said first and second members, said winding device further including a guide tube having an opening in one side thereof which is shaped to receive a portion of said housing having therein said opening in said housing in a manner so that said guide tube and said housing are in fluid communication through said openings therein.

21. An apparatus according to claim 20, including further detection means disposed adjacent said opening in said housing for producing a signal indicating whether a weft thread is extending through said opening in said housing, said further detection means including a holding plate supported on said housing and a light emitting element and two light receiving elements which are supported on said holding plate and are operatively coupled to said control means.

22. An apparatus according to claim 20, wherein said winding device includes means supporting said housing and guide tube for relative movement between a first position in which they are spaced from each other, and a second position in which said guide tube extends approximately perpendicular to said common axis and in which said portion of said housing is received in said opening in said guide tube so that the interior of said guide tube is in fluid communication with the interior of said housing through said opening in said housing.

23. An apparatus according to claim 20, wherein said portion of said housing is disposed in said opening in said guide tube, said guide tube extends approximately perpendicular to said common axis, and said guide tube and housing are fixedly secured to each other.

24. An apparatus according to claim 20, wherein said guide tube has a slit therein, has a transfer bar supported thereon for movement between a first position disposed substantially externally of said guide tube and a second position extending into said guide tube through said slit therein, and has means responsive to said control means for effecting movement of said transfer bar between said first and second positions thereof, wherein as said transfer bar moves from its first to its second position it can engage a weft thread in said guide tube and move such weft thread toward said opening in said housing.

25. An apparatus according to claim 20, wherein said guide means includes means for causing said fluid jet means to eject a jet of fluid from said nozzle hole in said second member in a manner causing air to flow into said housing through said opening therein, and includes guide nozzle means for producing a fluid jet which urges an improperly inserted weft thread in a direction toward said winding device.

26. An apparatus according to claim 10, wherein said winding device is positioned relative to the fabric being woven so that an improperly inserted weft is pulled away from the fell of the fabric as it is withdrawn from the warp shed.

* * * * *